US007862486B1

(12) United States Patent
Watson

(10) Patent No.: US 7,862,486 B1
(45) Date of Patent: Jan. 4, 2011

(54) EXERCISE APPARATUS WITH ROTATIONAL GRIPS

(75) Inventor: Joseph E. Watson, Fort Lauderdale, FL (US)

(73) Assignee: Spingrip Fitness, LLC, Lutz, FL (US)

( * ) Notice: Subject to any disclaimer, the term of this patent is extended or adjusted under 35 U.S.C. 154(b) by 0 days.

(21) Appl. No.: 12/568,273

(22) Filed: Sep. 28, 2009

(51) Int. Cl.
*A63B 21/072* (2006.01)

(52) U.S. Cl. ..... 482/106; 482/49; 482/139

(58) Field of Classification Search ..... 482/45, 482/49, 104, 106–107, 139; 74/552, 557
See application file for complete search history.

(56) References Cited

U.S. PATENT DOCUMENTS

| | | | | | |
|---|---|---|---|---|---|
| 3,384,370 | A * | 5/1968 | Bailey et al. | ..... | 482/106 |
| 4,585,229 | A | 4/1986 | Brasher | | |
| 4,618,183 | A | 10/1986 | Bauer | | |
| D287,526 | S | 12/1986 | Brockett et al. | | |
| 4,629,184 | A | 12/1986 | Selkee | | |
| 4,690,400 | A | 9/1987 | Metz | | |
| 4,770,409 | A | 9/1988 | Wallisch | | |
| RE033,218 | E | 5/1990 | Twardosz | | |
| 5,024,434 | A * | 6/1991 | Smith | ..... | 482/107 |
| 5,076,578 | A * | 12/1991 | Askonen | ..... | 482/139 |
| 5,211,616 | A * | 5/1993 | Riley, Jr. | ..... | 482/106 |
| 5,334,113 | A | 8/1994 | Roepke | | |
| 5,718,654 | A * | 2/1998 | Kennedy | ..... | 482/139 |
| 6,022,300 | A * | 2/2000 | Hightower | ..... | 482/106 |
| 6,652,420 | B2 * | 11/2003 | Chen | ..... | 482/45 |
| 7,094,186 | B2 * | 8/2006 | Diakonov et al. | ..... | 482/104 |
| 2005/0085352 | A1 * | 4/2005 | Baxter | ..... | 482/100 |
| 2005/0202942 | A1 * | 9/2005 | De Lano | ..... | 482/107 |
| 2007/0161468 | A1 * | 7/2007 | Yanagisawa et al. | ..... | 482/94 |
| 2008/0176723 | A1 * | 7/2008 | Johnson | ..... | 482/106 |

* cited by examiner

*Primary Examiner*—Fenn C Mathew
*Assistant Examiner*—Andrew M Tecco
(74) *Attorney, Agent, or Firm*—Jeremy D. Spier; Smith & Hopen, P.A.

(57) ABSTRACT

A barbell with rotational grips. The barbell includes a center bar with two grip housings of annular configuration mounted to opposite ends of the barbell. Handgrips are located within the grip housings. Two sets of bearings are diametrically opposed to one another at the ends of each handgrip. A first set of radial wall bearings are perpendicular to the rotational axis of the handgrip, and a second set of sidewall bearings are parallel to the rotational axis of the handgrip. Each grip housing has an interior circumferential groove, with radial and sidewall bearings operatively secured within the groove. Each hand grip is spring-loaded so that a constant force is applied perpendicular to the rotational axis of the handgrips.

5 Claims, 9 Drawing Sheets

EXERCISE APPARATUS WITH ROTATIONAL GRIPS

BACKGROUND OF THE INVENTION

1. Field of the Invention

This invention relates to a weightlifting apparatus. More particularly, it relates to a weightlifting barbell with rotational grips.

2. Description of the Prior Art

Weightlifting is an increasingly popular form of exercise. In weightlifting, barbells are used to lift and pull various weights. Barbells typically include various types of bars having a bent structure to accommodate a variety of grasping orientations, as disclosed in U.S. Design Pat. No. D287,526.

Weight training exercises can also be performed using dumbbells. Since one dumbbell is held in each hand, a user can freely rotate the wrist and hand throughout the full range of motion as an exercise is performed. For example, in performing a shoulder press with dumbbells, a user holds a dumbbell in each hand directly beside the shoulders, with the palms facing toward each other. Then the dumbbells are raised over the head, and the palms are rotated to face forward. Finally, the palms are rotated back to the starting position as the weights are lowered.

The same exercise cannot be performed with a conventional barbell because the hands and wrists are in a fixed position. Thus, it is not possible to use a conventional barbell to exercise the groups of muscles involved in pronation and supination as with dumbbells. Moreover, maintaining such a fixed position during exercises with the barbell increases strain on the wrists and elbows.

Prior art devices have attempted to impart some grip rotation to the conventional barbell. In particular, U.S. Pat. Nos. 3,384,370, 4,618,183, 4,629,184, 5,334,113, 6,022,300, 4,585,229, 7,094,186, 4,690,400, 5,211,616, Re. 33,218, and U.S. Pat. App. Publication No. 20080176723 all discuss barbell arrangements having handgrips that are rotatably supported so that their angle relative to the bar may be adjusted.

While these devices address the need for a rotational grip barbell, the designs of these devices create a high level of friction and instability. Particularly, the configuration of these devices results in metal-on-metal contact or the bearings do not address sidewall loads on the grip housings. The friction and instability causes the grips to freeze or stick in place, presenting a significant risk of injury.

Moreover, the prior art does not address the need for a rotational grip barbell that is adapted to utilize cable exercise equipment.

However, in view of the prior art considered as a whole at the time the present invention was made, it was not obvious to those of ordinary skill in the art how the limitations of the art could be overcome.

SUMMARY OF INVENTION

The long-standing but heretofore unfulfilled need for an improved exercise apparatus having rotational grips is now met by a new, useful, and nonobvious invention.

The novel barbell includes a pair of rotational grips that do not freeze or stick in place under load and which can be used in conjunction with cable exercise equipment.

The novel barbell includes a center bar with two grip housings of annular configuration located at opposite ends of said center bar. Handgrips are located within the annular grip housings. Two sets of bearings are diametrically opposed at the opposite ends of each handgrip. The first set of bearings (the radial wall bearings) is perpendicular to the rotational axis of the handgrip, and the second set of bearings (the sidewall bearings) is parallel to the rotational axis of the handgrip. Each grip housing has an interior circumferential groove, with the radial and sidewall bearings operatively secured within the groove. Each hand grip is spring-loaded so that a constant force is applied perpendicular to the rotational axis of the handgrips.

The novel barbell further includes a connector at the midpoint of the center bar, allowing the user to attach the free end of a cable extending from an exercise machine to said connector.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 4:
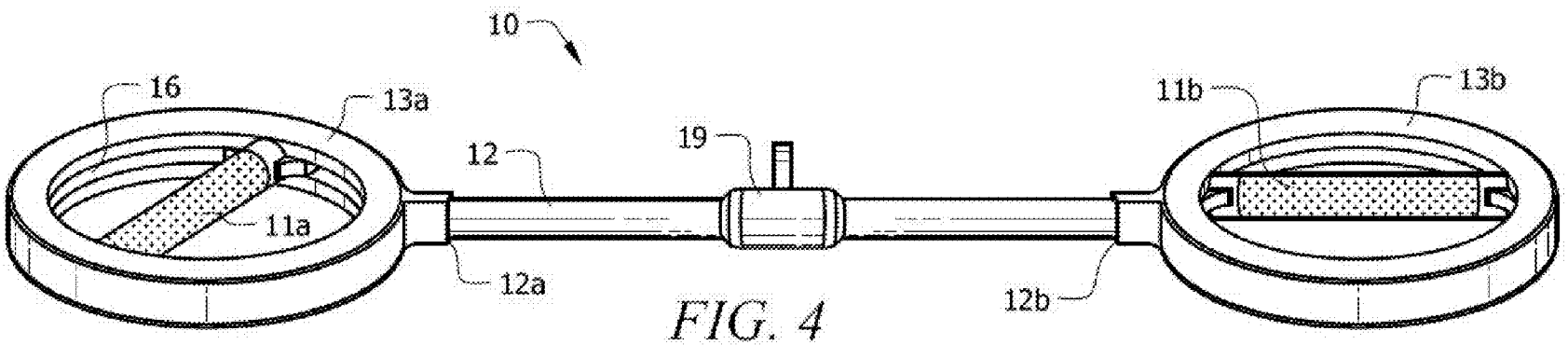
FIG. 4 is a perspective view of the barbell.
Figure 5:
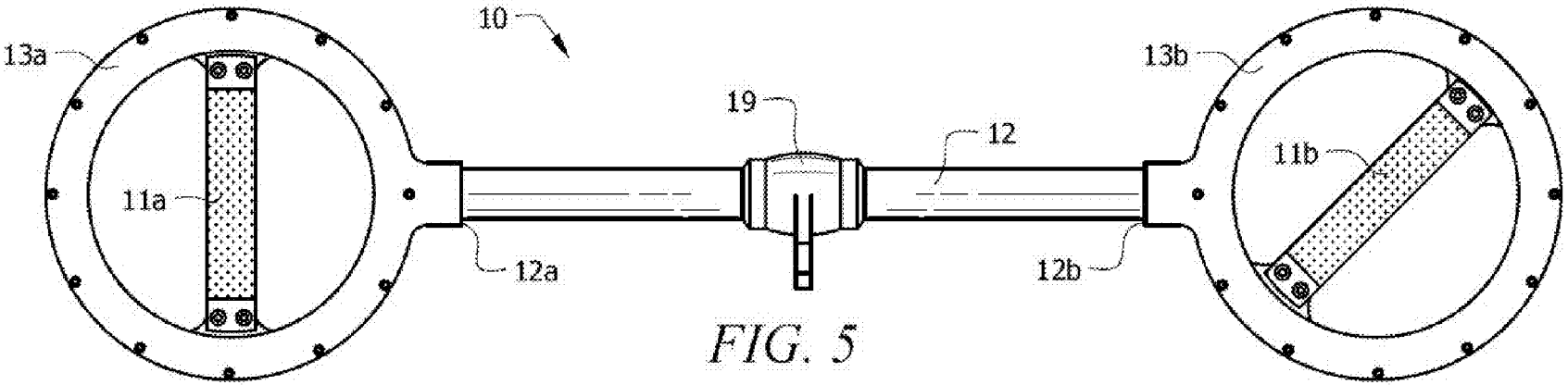
FIG. 5 is a perspective view of the barbell.
Figure 6:
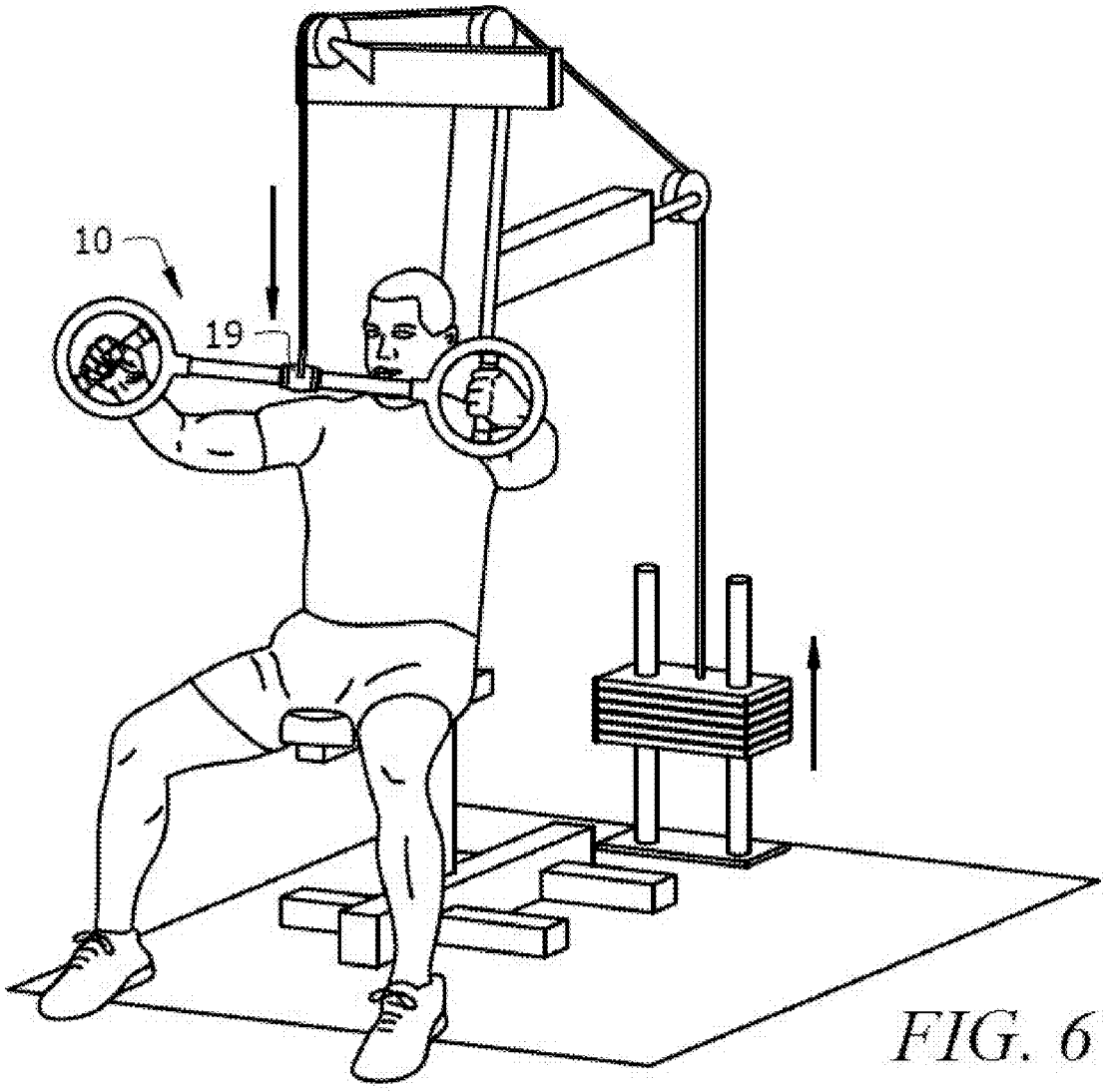
FIG. 6 depicts the barbell being used in connection with a cable machine.
Figure 7:
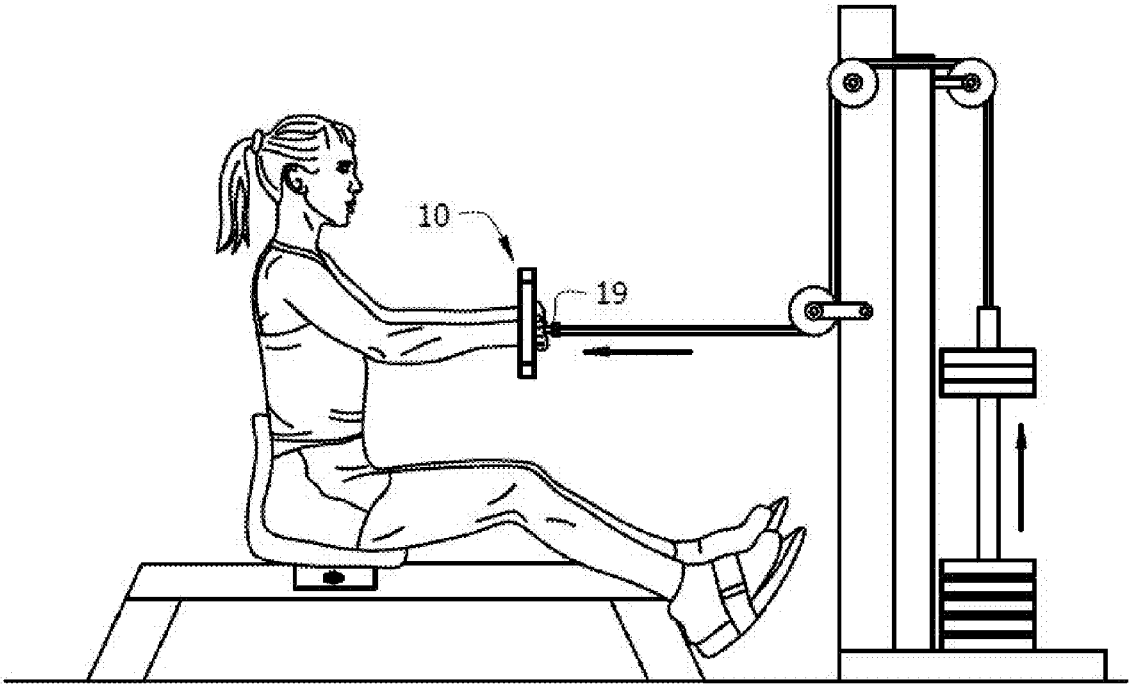
FIG. 7 depicts the barbell being used in connection with a cable machine.

Referring now to FIG. 4, it will there be seen that the reference numeral 10 indicates an illustrative embodiment of the invention as a whole.

Barbell 10 includes rotational grips at its opposite ends. The rotational grips allow the user to exercise the groups of muscles involved in pronation and supination, and reduces strain on the wrists and elbows. The bearing configuration and a constant spring pressure eliminates the risk of the handgrips freezing or sticking in place under load. The barbell is preferably used in conjunction with cable exercise equipment.

Center bar 12 has ends 12*a* and 12*b*. Grip housings 13*a* and 13*b* are attached to center bar 12 at ends 12*a* and 12*b*, respectively. Handgrips 11*a* and 11*b* are secured within grip housings 13*a* and 13*b*, respectively.

As depicted in FIGS. 1-4, each grip housing 13*a* and 13*b* has an interior circumferential groove 16. Each handgrip 11*a* and 11*b* has diametrically opposed radial bearings 15*a* and 15*b* that are located within interior circumferential groove 16. Radial bearings 15*a* and 15*b* are perpendicular to the axis of rotation of handgrips 11*a* and 11*b*. Radial bearings 15*a* and 15*b* are in contact with and support loads along the radial wall of grip interior circumferential groove 16. Similarly, each handgrip 11*a* and 11*b* has diametrically opposed sidewall bearings 14*a* and 14*b* that are located within interior circumferential groove 16. Sidewall bearings 14*a* and 14*b* are parallel to the axis of rotation of handgrips 11*a* and 11*b*. Sidewall bearings 14*a* and 14*b* are in contact with and support loads along the sidewalls of interior circumferential groove 16.

Radial bearings 15*a* and 15*b* and sidewall bearings 14*a* and 14*b* allows handgrips 11*a* and 11*b* to rotate within grip housings 13*a* and 13*b*. Specifically, as illustrated in FIG. 4, radial bearings 15*a* and 15*b* and sidewall bearings 14*a* and 14*b* rotate within interior circumferential groove 16. The combination of radial bearings 15*a* and 15*b* and sidewall bearings 14*a* and 14*b* allows the user to move barbell 10 in multiple directions under multiple loads without handgrips 11*a* and 11*b* freezing or sticking in place within grip housings 13*a* and 13*b*.

Figure 1:
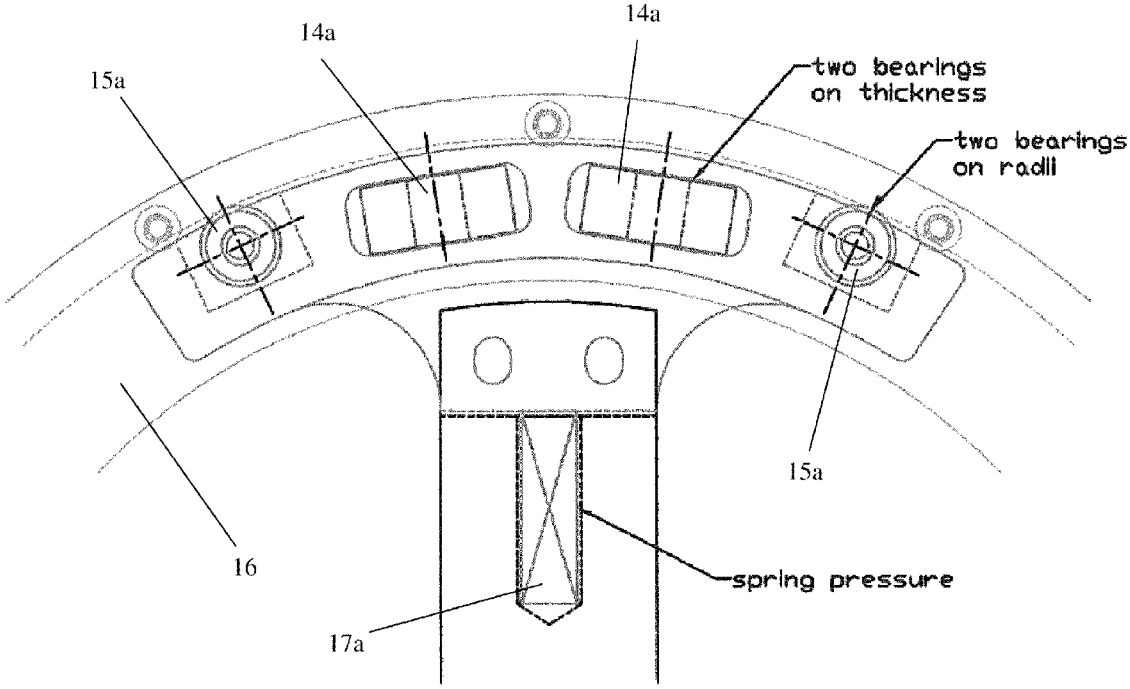
FIG. 1 is a top view of the bearings.
Figure 2:
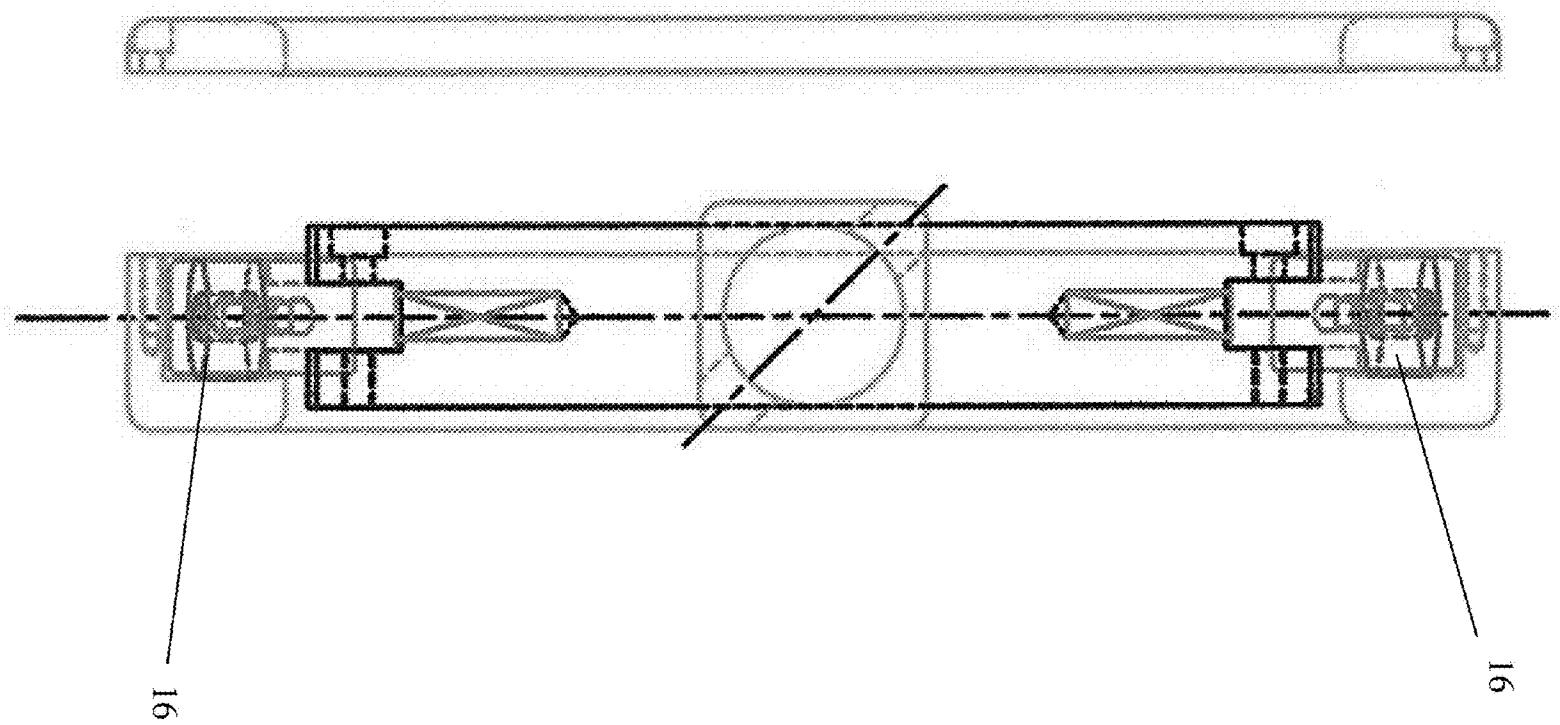
FIG. 2 is a cross-sectional side view of the barbell.
Figure 3:
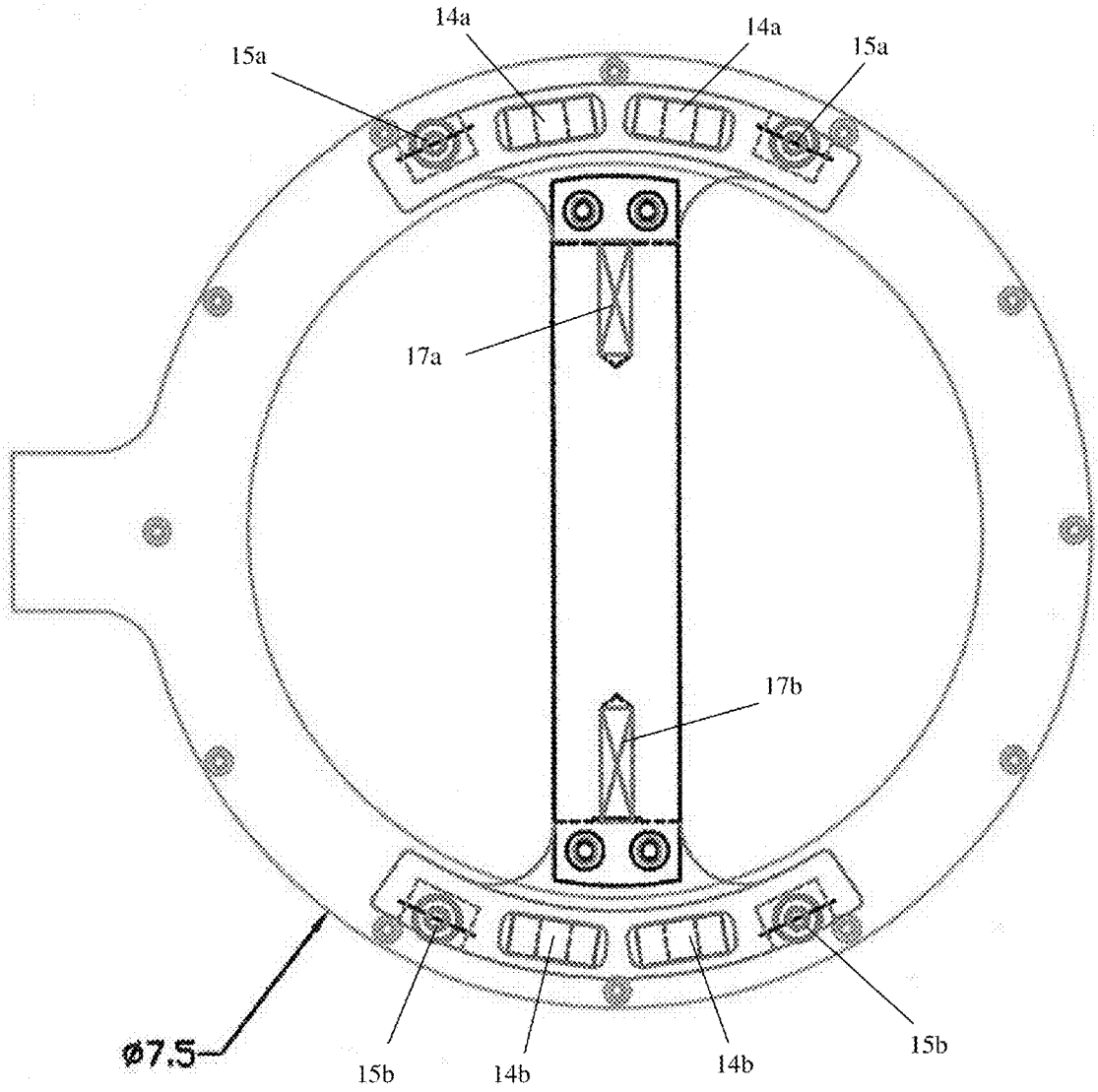
FIG. 3 is a top view of the grip housing.

As illustrated in FIGS. 1-3, handgrips 11*a* and 11*b* are spring loaded. Springs 17*a* and 17*b* exert a constant radial pressure on radial bearings 15*a* and 15*b*. This radial pressure adds stability by keeping radial bearings 15*a* and 15*b* in constant contact with the radial wall of interior circumferential groove 16.

As shown in FIGS. 4-7, connector 19 is secured at the midpoint of center bar 12. Connector 19 allows the user to attach barbell 10 to the free end of a cable extending from an exercise machine. Once connected to the cable, the user can perform a variety of exercises, such as a row or pull down. Connector 19 is rigidly affixed to center bar 12 or, in an alternate embodiment, connector 19 is affixed to center bar 12 such that connector 19 is rotatable around the longitudinal axis of center bar 12.

Figure 8:
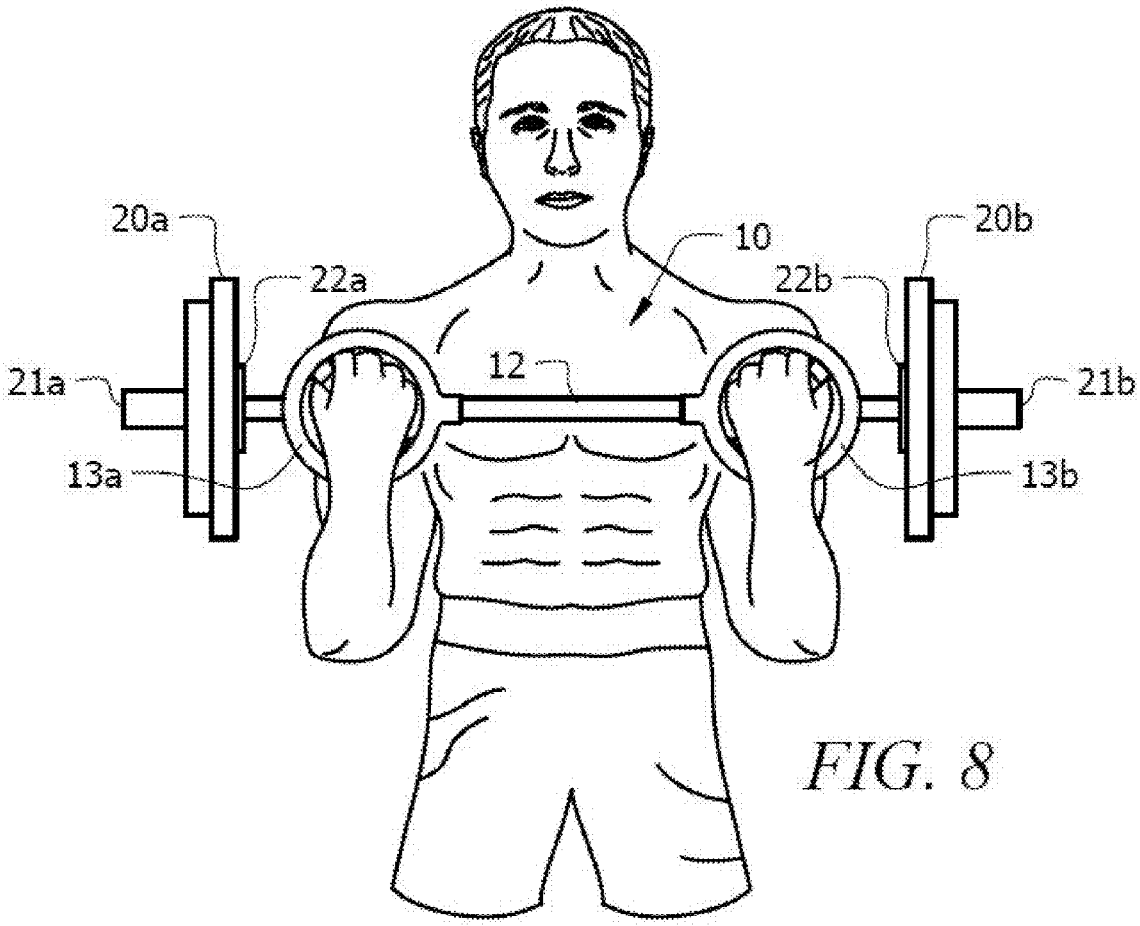
FIG. 8 depicts the barbell being used in connection with free weights.
Figure 9:
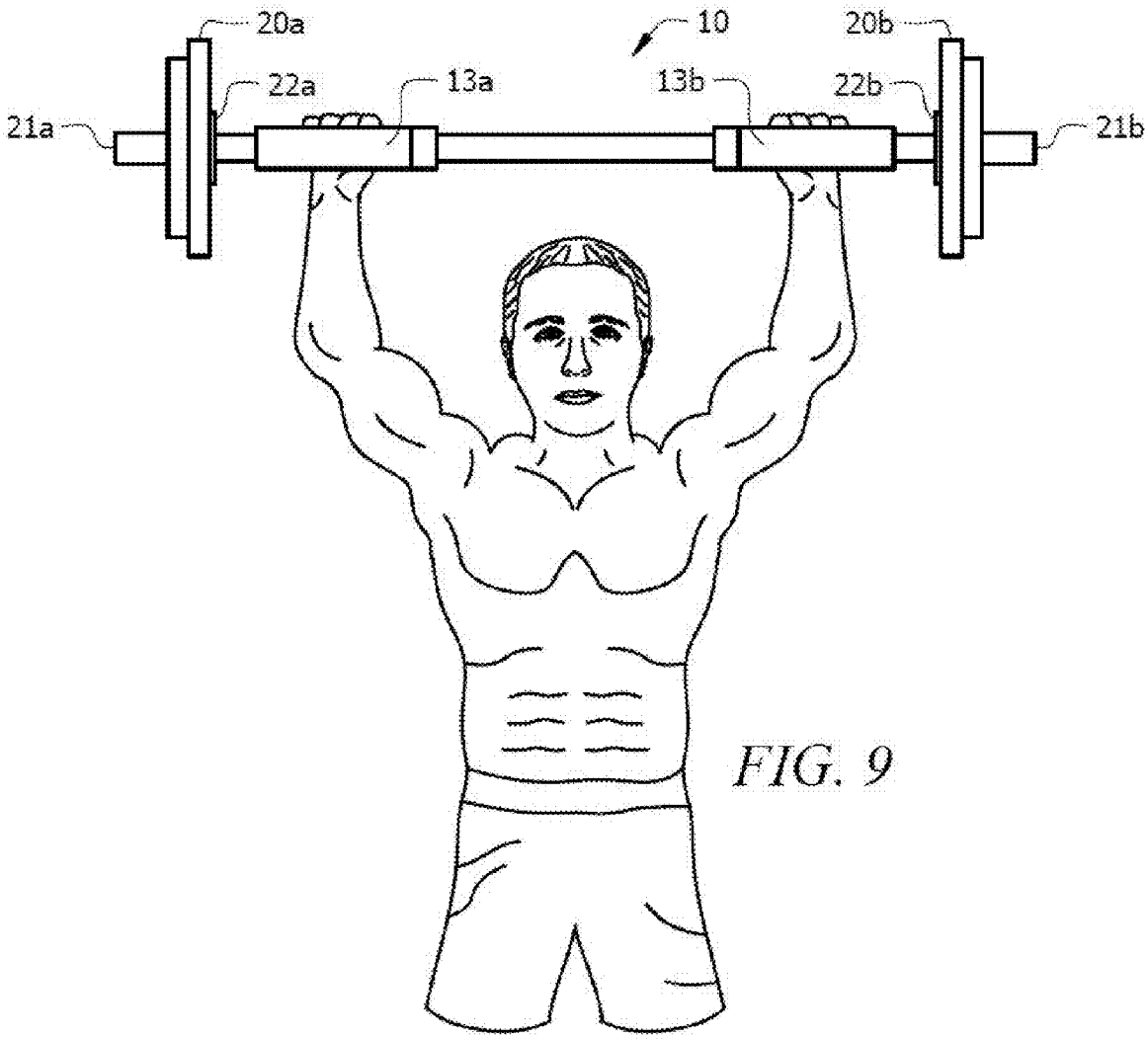
FIG. 9 depicts the barbell being used in connection with free weights.

In an alternate embodiment, as depicted in FIGS. 8 and 9, barbell 10 includes outer bars 21*a* and 21*b* which share an axis with center bar 12 and extend outward from grip housings 13*a* and 13*b*. Outer bars 21*a* and 21*b* are adapted to receive weights 20*a* and 20*b* and have collars 22*a* and 22*b* to prevent weights 20*a* and 20*b* from sliding into grip housings 13*a* and 13*b*. This embodiment allows the user to use free weights when exercising.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

What is claimed is:

1. A weightlifting barbell, comprising:

a center bar having a first end and a second end;

a first grip housing attached to said center bar at said first end;

a second grip housing attached to said center bar at said second end;

an interior circumferential groove disposed within said first and second grip housings;

a first and second handgrip, said first and second handgrips each having a first and second end;

a plurality of radial wall bearings located at each of said first and second ends of said first and second handgrips, said radial wall bearings being circular in shape with said circular surfaces of said radial wall bearings being perpendicular to the axis of rotation of said first and second handgrips;

a plurality of sidewall bearings located at each of said first and second ends of said first and second handgrips, said sidewall bearings being circular in shape with said circular surfaces of said sidewall bearings being parallel to the axis of rotation of said first and second handgrips, said first handgrip being rotatably engaged within said first grip housing with said radial wall bearings and said sidewall bearings being disposed within said interior circumferential groove, said second handgrip being rotatably engaged within said second grip housing with said radial wall bearing and said sidewall bearings being disposed within said interior circumferential groove; and a first spring disposed at each said first end of said handgrips and a second spring disposed at each said second end of said handgrips so that a constant force is applied to said radial wall bearings.

2. The weightlifting barbell of claim 1, further comprising:

a first outer bar attached to said first grip housing in coaxial relation to said center bar; and a second outer bar attached to said second grip housing in coaxial relation to said center bar, said first and second outer bars each adapted to receive at least one weight.

3. The weightlifting barbell of claim 2, further comprising:

said first and second outer bars each having a collar.

4. The weightlifting barbell of claim 1, further comprising:

attachment means adapted to releasably attach said center bar to a cable exercise machine.

5. The weightlifting barbell of claim 4, further comprising:

said attachment means being capable of revolving 360 degrees.

* * * * *